US005461193A

United States Patent [19]

Schertler

[11] Patent Number: 5,461,193

[45] Date of Patent: Oct. 24, 1995

[54] SOUND PICK-UP FOR RESONANT BODIES

[76] Inventor: Stephan Schertler, Via Furnasee, CH-6853 Ligornetto, Switzerland

[21] Appl. No.: 177,217

[22] Filed: Jan. 4, 1994

[30] Foreign Application Priority Data

Jan. 25, 1993 [AT] Austria ..... 109/93

[51] Int. Cl.[6] ..... G10H 3/18

[52] U.S. Cl. ..... 84/727

[58] Field of Search ..... 84/725–728

[56] References Cited

U.S. PATENT DOCUMENTS 3,725,561 4/1973 Paul ..... 84/726

5,335,576 8/1994 Hayashi ..... 84/727

FOREIGN PATENT DOCUMENTS 2316000 11/1975 Germany .

*Primary Examiner*—Stanley J. Witkowski

*Attorney, Agent, or Firm*—Friedrich Kueffner

[57] ABSTRACT

A sound pick-up for frequencies in the audible range, particularly for musical instruments have resonant cavities, such as string instruments, includes a housing which can be secured to the resonant body of the instrument and an induction coil whose connections extend outwardly through the housing. A wall portion of the housing connected to the resonant body supports the induction coil. The induction coil projects into an annular gap of a permanent magnet which is supported in a spring-elastic manner in the housing. The spring-elastic support of the permanent magnet makes it possible that the permanent magnet is movable in axial direction of the induction coil and relative to the housing.

14 Claims, 2 Drawing Sheets

SOUND PICK-UP FOR RESONANT BODIES

BACKGROUND OF THE INVENTION

1. Field of the Invention

The present invention relates to a sound pick-up for frequencies in the range of audibility, particularly for musical instruments with resonant cavities, such as, string instruments. The sound pick-up includes a housing which can be fixed to the resonant body or cavity of the instrument and an induction coil or moving coil whose connections are conducted outside through the housing.

2. Description of the Related Art

Different embodiments of sound pick-ups have become known in the art. The sound pick-ups differ essentially from each other by the principal by which they operate. The known sound pick-ups operate in accordance with the piezoelectric principle, according to the electrostatic principle, or they are constructed as capacitor sound pick-ups. All of these sound pick-ups have in common that their dynamic properties are not properly balanced and they do not have a linear frequency pattern.

DE-OS 23 16 000 discloses a sound pick-up which includes a cylindrical housing in which an induction coil is mounted. This housing is mounted so as to be stationary relative to the musical instrument or the vibrating part thereof. A permanent magnet projecting into the induction coil is connected to the vibrating part of the musical instrument. Above the coil which is mounted stationary in the housing and separately from this coil is arranged a disk-shaped ferromagnetic body in an elastic, flat cushion, wherein the cushion surrounds the ferromagnetic body in its entirety and with play. This configuration of the sound pick-up is supposed to make it possible that only sounds emanating from the musical instrument are transmitted, but not sounds from the surrounding space, over the entire frequency range of the musical instrument. From the structural configuration of the known sound pick-up it is clear that it operates with forced excitation; in other words, the sound pick-up must be at rest relative to the musical instrument for producing a differential voltage.

The known sound pick-up has the following additional disadvantages. The known sound pick-up cannot be mounted in a freely vibrating manner. The vibrating behavior of the known sound pick-up is not sufficiently defined and it does not have any damping or only little damping. Because of the two vibrating parts, the resonant frequency must be expected in the middle range of audibility. For achieving useful voltages, the coil must be constructed with high impedance. The specification of DE-OS 23 16 000 even mentions the danger of humming. The musical instrument is strongly dampened by pressing the sound pick-up against a resting plane. For example, as shown in DE 23 16 000, a drum skin would be dampened very strongly. A free vibration is no longer ensured under these conditions. When the sound pick-up is mounted on a guitar, the vibrations of the strings are conducted through the elastic part of the sound pick-up before they can be transmitted through the sound pick-up housing and the screws onto the sound board. This significantly impairs the sound of a guitar and, depending on the type of guitar, may make the guitar useless.

SUMMARY OF THE INVENTION

Therefore, it is the primary object of the present invention to provide a sound pick-up of the above-described type which is constructed in such a way that its dynamic properties and frequency pattern are improved relative to known sound pick-ups.

In accordance with the present invention, the induction coil is mounted on a wall portion of the housing which can be secured to the resonant body. The induction coil projects into an annular gap of a permanent magnet which is mounted in the housing by spring-elastic support means. The spring-elastic support means make it possible that the permanent magnet is movable in axial direction of the induction coil and relative to the housing.

The proposal according to the present invention provides a dynamic sound pick-up with essentially two planes, i.e., the vibrating plane which is represented by the instrument and a second plane which is decoupled or neutralized through the spring-elastic support means. The movement differential of the two planes is converted by the coil and magnet system into electrical voltage. The dynamic behavior of the decoupled plane is defined by the filter theory. It is a filter of the second degree (spring/mass). With accurate tuning or damping according to Butterworth, the produced voltage, i.e., the differential movement of the two planes, corresponds exactly to the movement of the vibrating plane, i.e., of the instrument. When the resonant frequency of the decoupled plane is, for example, 50 Hz, the voltage decrease is 3 dB and, below this frequency, the voltage decrease is 12 dB per halving of the frequency. In the sound pick-up according to the invention, the vibrations of the instrument are picked up extremely precisely if the sound pick-up does not dampen the instrument. This requirement is met in the sound pick-up proposed in accordance with the present invention. A portion of the vibrations is not conducted through the spring-elastic support means to the magnet; this results in phase displacements and, thus, in sound discolorations. However, these results cannot be completely avoided.

Apart from these slight sound discolorations, the sound pick-up according to the present invention meets all the requirements of a naturally sounding sound pick-up.

In contrast, the piezoceramic sound pick-ups operate only on one plane and, thus, operate with forced excitation. Accordingly, the piezoelectric element vibrates together with the instrument and "bending" thereof for generating the voltage is no longer dependent randomly or strongly on the mass and, thus, on resonant locations. These sound pick-ups are developed exclusively empirically. In order to increase the bass reproduction which is very weak in these sound pick-ups, they are clamped, for example, in the neck of the instrument. However, this produces unnatural low basses and the reproduction appears very squeezed. The dynamic properties of these sound pick-ups are very limited. High amplitudes are cut by the attendant vibration of the piezoelectric element. Accordingly, these sound pick-ups are useless particularly in strongly vibrating instruments, such as, pianos.

Electrostatic pick-ups are better in many respects than piezoelectric pick-ups because the problems of "bending" do not occur. However, the "decoupled plane" produced, for example, by an elastic material such as cork, is also not defined and the listening range is discolored by many resonant locations. Also in this case, large vibrations lead to distortions.

The sound pick-up according to the present invention can be mounted so as to be freely vibrating and, therefore, can be used for a wide variety of purposes. The vibration behavior of the sound pick-up is defined. The system mass/spring (magnet/spring) forms a vibrating circuit of the second degree. The connection of moving coil with cup-shaped magnet makes it possible to use for the production of useful voltages a moving coil with low impedance which has a high efficiency. In addition, the sound pick-up makes possible a simple electric tuning, has little danger of humming, has a high signal-to-noise ratio, and has low cable losses. The musical instrument or the sound board thereof is dampened only by the mass of the sound pick-up. Since the sound pick-up in practice has a mass of approximately of 15 g, the damping is within the hardly audible range. An audible damping occurs only in the case of very lightweight resonant surfaces, such as, a drum skin. However, this damping is still substantially lower than that of a pressed-on sound pick-up, as described and shown in DE-OS 23 16 000. In that case, the permanent magnet is separate from the housing and connected directly to the vibrating part of the musical instrument, i.e., either to the drum skin or to the strings. In accordance with the present invention, on the other hand, the permanent magnet is suspended in a spring-elastic manner in the housing which, in turn, is connected to the vibrating part of the musical instrument. Also, in accordance with the present invention, the moving coil is located on that housing wall which is fixed to the vibrating part of the musical instrument. In the sound pick-up according to DE-OS 32 16 000, the moving coil is fixedly mounted in the housing which, in turn, is stationary relative to the drum skin.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
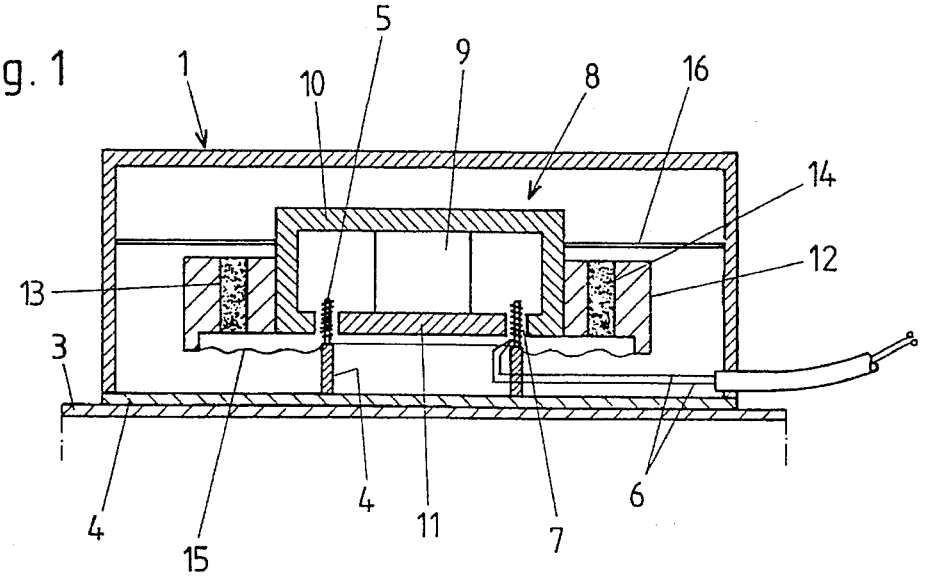
FIG. 1 is a cross-sectional view of a first embodiment of the sound pick-up according to the present invention.

In the first embodiment according to the present invention illustrated in FIG. 1, the sound pick-up includes a housing 1 which is connected with a wall portion 2 thereof to a resonant cavity or body 3 of a string element, not illustrated in the drawing. The wall part 2 is connected to the resonant body 3, for example, by gluing or cementing. A cylindrical moving coil 5 is arranged with a connecting web 4 on the inner side of the wall part 2. Specifically, the moving coil 6 is arranged in the middle portion of wall part 2. The connections 6 of the moving coil 5 extend outwardly.

The moving coil 5 projects into the annular gap 7 of a permanent magnet 8 which is composed of the actual cylindrical magnet 9, a cup-shaped iron yoke 10 and a disk-shaped iron yoke 11. The permanent magnet 8 is received by a ring-shaped carrier member 12 which has a plurality of bores 13 which extend parallel to the axis of the magnet. A damping material 14, for example, a felt, is filled into the bores 13.

A perforated disk-shaped diaphragm 15 is connected with its outer rim to the outer rim of the carrier member 12 and with its inner rim to the connecting web 4 for the moving coil 5. The carrier member 12 with the permanent magnet 8 is supported by a plate-shaped spring 16 which is very stiff in its own plane, while it is very soft in the direction perpendicular to its own plane, i.e., in axial direction of the sound pick-up. This spring 16 is fastened with its outer rim to the inner side of the housing 1 and with its inner rim to the permanent magnet 8.

Figure 5:
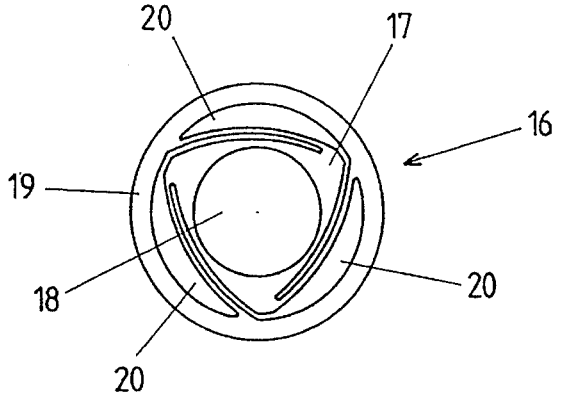
FIG. 5 is a plan view of a spring used in the sound pick-up according to the present invention.

An advantageous configuration of the spring 16 is illustrated in FIG. 5 in a plan view. The spring 16 includes a middle portion 17 with a central opening 18 for receiving the permanent magnet 8, an outer rim 19 which is fastened to the housing 1 and a plurality of arms 20 which connect the rim 19 and the middle portion 17. The spring 16 is constructed in one piece. The spring of this type has a very soft elasticity in the direction perpendicular to the plane of the drawing of FIG. 5, while it is very stiff in the plane of the drawing.

The spring 16 serves to decouple the permanent magnet 8 from the housing 1 and to enable the permanent magnet 8 to vibrate freely in its axis, independently of the respective spatial position of the sound pick-up. The purpose of the diaphragm 15 is to ensure the necessary damping of the system, depending on which type of instrument the sound pick-up is to be mounted on. The sound pick-up is to be tuned at the manufacturer, so that maximum transmission properties are ensured. This tuning is achieved by means of the spring 16 by using springs of different elasticity. Tuning is further achieved by the damping material 14 to be introduced into the bores 13.

Figure 2:
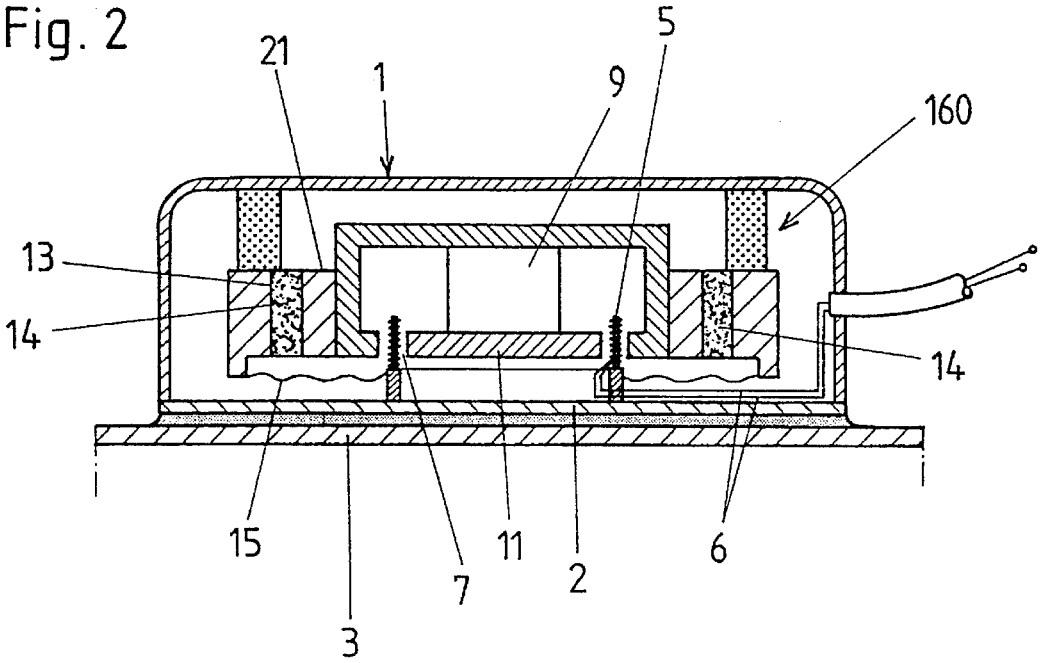
FIG. 2 is a cross-sectional view of a second embodiment of the sound pick-up according to the present invention.

In the embodiment illustrated in FIG. 2, the spring is a ring 160 of macromolecular foam material. The ring 160 is connected with one end face on the inner side of the housing 1 and with another end face on the upper side 21 of the carrier member 12. Instead of providing a circumferentially closed ring 160, the spring can also be a ring composed of several sections which follow each other spaced apart in circumferential direction.

Figure 3:
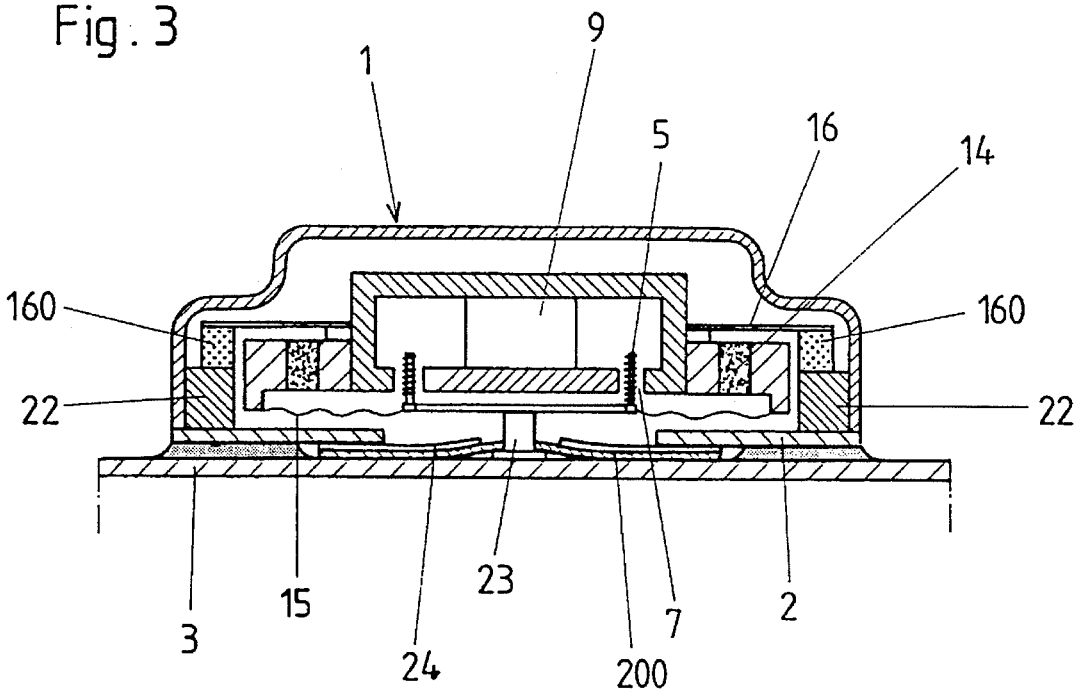
FIG. 3 is a cross-sectional view of a third embodiment of the sound pick-up according to the present invention.

In the embodiment illustrated in FIG. 3, the elements forming the spring in the embodiments of FIGS. 1 and 2 are arranged in a common arrangement. The spring 160 of macromolecular material constructed as a ring is connected with an end face to a shoulder 22 projecting on the inner side of the housing 1, and the other end face is attached to the rim 19 of the spring 16. Moreover, in this embodiment, the middle portion of the wall part 2 is formed by a rubber disk 200 which in the center thereof supports a pin 23 which, in turn, is on its inner side connected to the moving coil 5. The outer end face of the rubber disk 200, on the other hand, rests directly on the resonant body 3 of the instrument which is not illustrated in detail. The pin 23 serves the purpose of a sensor and, in order to ensure that it contacts the resonant body 3 of the instrument, plate-shaped springs 24, for example, in a star-like arrangement can be provided on the inner side of the rubber disk 200, wherein the springs 24 press the pin 23 serving as a sensor against the resonant body 3.

Figure 4:
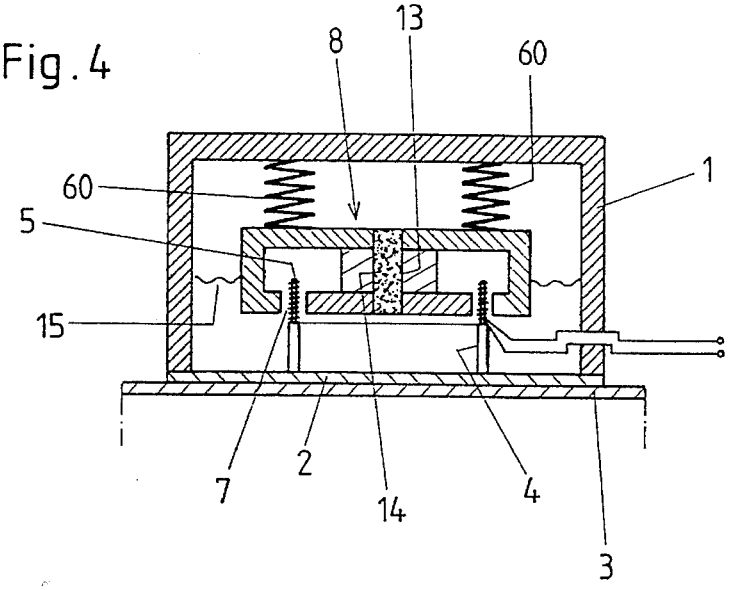
FIG. 4 is a cross-sectional view to illustrate the principle of the sound pick-up according to the present invention.

In the embodiments illustrated in FIGS. 1, 2 and 3, the diaphragm 15 is arranged in the same way. However, this arrangement is not absolutely necessary. FIG. 4 of the drawing shows in a cross-sectional view the principle of the present invention is a simplified representation. The perforated disk-like diaphragm 15 is in this case connected directly to the permanent magnet 8, on the one hand, and to the inner side of the housing 1, on the other hand. The bore 13 with the damping material 14 is provided in the permanent magnet 8 which, in this case, is suspended in the housing 1 through several helical springs 60. Instead of the springs 16, 60 and 160 described above and shown in the drawing, it is also possible to provide plate-shaped strip springs. Independently of the configuration of the springs, the springs serve the purpose of decoupling the permanent magnet relative to the housing 1 and to support the permanent magnet in such a way that it can vibrate freely and easily in axial direction thereof, while in the transverse direction it has no possibility of yielding or only a slight possibility of yielding.

Finally, it should be noted that the sound pick-up illustrated in the drawing is shown on a scale which is larger than actual size.

The invention is not limited by the embodiments described above which are presented as examples only but can be modified in various ways within the scope of protection defined by the appended patent claims.

I claim:

1. A sound pick-up for frequencies in the range of audibility for resonant bodies, the sound pick-up comprising a housing, the housing having a wall part adapted for connection to a resonant body, an induction coil having connections extending through the housing and outside of the housing, the induction coil being mounted on the wall part of the housing mounted on the resonant body, a permanent magnet mounted in the housing, the permanent magnet having an annular gap, the induction coil projecting into the annular gap of the permanent magnet, a spring-elastic support means for supporting the permanent magnet, such that the permanent magnet is movable by the spring-elastic support means in axial direction of the induction coil and relative to the housing.

2. The sound pick-up according to claim 1, wherein the spring-elastic support means comprises a disk-shaped plate spring, the plate spring comprising a middle portion, an outer rim and a plurality of arms extending essentially in circumferential direction and connecting the middle portion and the outer rim, wherein the middle portion of the plate spring is connected to the permanent magnet and the outer rim of the plate spring is fastened to the housing.

3. The sound pick-up according to claim 1, wherein the spring-elastic support means comprises a support member of macromolecular foam material connected between the permanent magnet and the housing.

4. The sound pick-up according to claim 3, wherein the support member is a ring of macromolecular foam material, wherein the ring has an axis which is in alignment with the axis of the permanent magnet.

5. The sound pick-up according to claim 2, comprising a support member of macromolecular foam material for connecting the outer rim of the plate spring to the housing.

6. The sound pick-up according to claim 5, wherein the support member is a ring.

7. The sound pick-up according to claim 1, wherein the wall part of the housing resting against the resonant body has at least a portion of elastically deformable material, wherein the portion of elastically deformable material is connected to a pin having first and second ends, the first end resting against the resonant body and the second end supporting the induction coil.

8. The sound pick-up according to claim 1, comprising a diaphragm connected to the induction coil.

9. The sound pick-up according to claim 8, wherein the housing has an interior, the diaphragm being mounted so as to divide the interior into two chambers, further comprising communication means between the two chambers, wherein damping materials are arranged in the communication means.

10. The sound pick-up according to claim 8, further comprising a ring-shaped carrier member surrounding the permanent magnet, the diaphragm having an outer edge connected to the carrier member.

11. The sound pick-up according to claim 10, wherein the communication means are axially extending bores in the carrier member, and wherein the damping materials are arranged in the bores.

12. The sound pick-up according to claim 1, wherein the spring-elastic support means comprises a plurality of strip-shaped spring members arranged in a star-like configuration.

13. The sound pick-up according to claim 9, wherein the damping material is felt.

14. The sound pick-up according to claim 1, wherein the spring-elastic support means comprises helical springs, the helical springs having axes, the axes of the helical springs extending parallel to the axis of the induction coil, a perforated disk-shaped diaphragm having an inner rim and an outer rim, the housing having an inner side and an interior, the inner rim of the diaphragm being connected to the permanent magnet and the outer rim of the diaphragm being connected to the inner side of the housing, such that the interior of the housing is divided into two chambers, the permanent magnet defining a bore for effecting communication between the chambers, wherein the bore is filled with damping material.

* * * * *